US005119964A

United States Patent [19]

Witt

[11] Patent Number: 5,119,964

[45] Date of Patent: Jun. 9, 1992

[54] CLOSURE FOR A CONTAINER

[76] Inventor: Stephen H. Witt, 5 Tara Place, Smithville, Ontario, Canada, L0R 2A0

[21] Appl. No.: 681,827

[22] Filed: Apr. 8, 1991

Related U.S. Application Data

[63] Continuation-in-part of Ser. No. 605,315, Oct. 30, 1991, abandoned.

[51] Int. Cl.[5] ..... B65D 41/00

[52] U.S. Cl. ..... 215/251; 215/232

[58] Field of Search ..... 251/232, 251, 253, 257; 220/358

[56] References Cited

U.S. PATENT DOCUMENTS

| | | | |
|---|---|---|---|
| 2,079,757 | 5/1937 | Berk | 215/257 |
| 4,778,069 | 10/1988 | Keller | 215/232 |
| 4,872,571 | 10/1989 | Crecelius et al. | 215/232 |
| 5,012,946 | 5/1991 | McCarthy | 220/258 |

*Primary Examiner*—Stephen Marcus
*Assistant Examiner*—Nova Stucker
*Attorney, Agent, or Firm*—Rogers, Bereskin & Parr

[57] ABSTRACT

A closure for a container has two parts, namely an inner sealing member and an outer cap. The inner sealing member has a tab extending down between a bottle neck and a depending side wall of the cap. The tab is folded around the cap wall to form an upwardly extending portion. A patch of adhesive secures this tab portion to the cap. This prevents unauthorized removal of the cap and provides visible and external evidence of any tampering.

14 Claims, 2 Drawing Sheets

CLOSURE FOR A CONTAINER

CROSS REFERENCE TO RELATED APPLICATION

This application is a Continuation-in-Part of my earlier application Ser. No. 605,315 filed Oct. 30, 1991, now abandoned.

FIELD OF THE INVENTION

This invention relates to a closure for a container, and more particularly, but not exclusively, relates to a two-piece enclosure for a glass bottle.

BACKGROUND OF THE INVENTION

At the present time, at least in Canada, most milk and other dairy products are sold in disposable containers, e.g. cardboard cartons or plastic bags. In some areas, reusable glass bottles are used, but this is a relatively small part of the whole market. Nonetheless, in view of the increasing environmental concerns regarding disposable packaging, the use of the glass bottles for milk and other dairy products is increasing rapidly, currently, at an annual rate of approximately 25%.

A problem arises with providing a simple and economical closure for glass milk bottles. A variety of different closures are known. One type with which the applicant is familiar and currently produces is formed from a paper foil laminate. A cap is a disk form cut from laminate and then crimped around the neck of a milk bottle. It thus forms a top, circular, closure portion, with a shirt portion depending downwardly. The skirt portion is crimped against the neck of the bottle. In a variant, a cardboard disk is mounted to the top of the closure. The top of the closure is then dished down inside the neck of the bottle, so that the cardboard disk is within the neck of the bottle.

Whilst this type of closure is relatively simple and economical, it suffers from a number of disadvantages. First, it does not provide any true evidence of tampering with the container. It is conceivable that someone could remove the closure, and somehow tamper or interfere with the contents of the bottle, and then replace the closure. Further, whilst in normal use, the closure can be replaced after it has been opened, it does not provide wholly satisfactory resealing of the bottle by simply being placed on it.

It is desirable that a closure for a glass milk bottle, and other containers, should meet two requirements. First, it should provide clear tamper evidence, of any tampering of the bottle or its contents, which preferably should be readily externally visible. This then enables a consumer in a store to immediately ascertain whether the bottle has been tampered with or not, without the necessity for removing any external cap or cover member. Secondly, the closure should enable the bottle or other container to be satisfactorily resealed, so that where only part of the contents are used, it can be resealed and retain the remaining contents in good condition.

Further, for a two-part closure, i.e. one which includes an inner seal effecting a primary closure of the container and a secondary outer cap or closure, it is desirable to have some means to prevent caps being switched between different bottles or containers. For example, for dairy products, it is known for unscrupulous consumers to switch caps between products of different price, e.g. 2% milk and cream, in order to be able to purchase the more expensive product at a lower price.

There are a wide variety of conventional tamper-evident closures on the market. These are generally unsuitable for glass bottles. Many of these are in the form of plastic-moulded caps. In one common design, a screw cap is secured to a ring by a number of small, radial spokes. The ring engages part of the bottle so that when the cap is unscrewed the spokes shear, thereby giving an indication that the container has been opened. This cannot be used on glass milk bottles, since they do not include a screw thread, and since the tolerances obtainable with glass would not permit the cover to always securely engage the bottle.

Another design employs a collar connected to a cap by an annular strip, which extends through slightly less than a full circle, to leave the cap secured to the collar by a short connecting strip. The strip is provided with tab, to enable it to be removed, thereby largely detaching the cap from the collar. The cap can then be hinged upwardly to open the bottle, whilst remaining attached to the collar at one edge. Yet another design is a simple plastic cap with a pull ring. Such arrangements again require fairly tight tolerances on the bottle neck, and this is not readily or routinely achieved with a glass milk bottle.

It is also desirable that any primary or inner seal for the container or bottle should be readily removable, and should be capable of simple and economic manufacture and mounting on the container. It is well known to provide a foil closure seal to the neck of a container, although this is not routinely done with glass bottles since it is difficult to obtain an adhesive that provides a good seal to glass. Many such closures are provided with some sort of tab to facilitate removal of the foil. Where an outer cap is provided, the tab is usually folded over on top of the main body of the foil, so as not to interfere with screw threads, etc. which secure the cap to the bottle neck.

U.S. Pat. No. 4,155,439 discusses in detail the production of a foil closure with a folded pull tab. As this patent shows, complex machinery is required to form the closure and fit it to the container. A circular table or platform is provided, in which the containers are placed. The table is then rotated, to move each container through numerous different stations. At each station, a different operation is performed. The closure itself is stamped from a strip of foil, and then the tab has to be folded up on top of the main portion of the closure. This requires a complex sequence or operation. To set up such machinery for a particular production run is time consuming and expensive.

It is should also be noted that additional problems are also encountered with such a technique. Firstly, the presence of the inwardly folded tab can affect the sealing by means of induction heating. Induction heating relies upon the generation of currents to heat the foil. The presence of the tab affects the electrical properties locally, and can result in improper sealing. As discussed in an article by Bill Zito in the August, 1986 issue of Food and Drug Packaging, the current tends to follow the actual periphery of the tab. Also, the folded tab can stick to the inside of the cap, which then requires a silicon liner or the like. The induction sealing technique further relies upon the fact that the foil closure is pressed against the neck of the container by the cap. For the folded tab, there may not be even pressure applied to the foil closure which again can result in an imperfect sealing.

With such a folded tab, there is no external evidence of any tampering with the container, so that strictly a consumer needs to remove the screw cap or the like to ascertain that the inner seal is intact. Further, there is nothing to prevent a consumer switching caps between containers or bottles.

As mentioned above, it is commonly known to provide a foil closure with some sort of tab extending out from the neck of the container, to facilitate removal of the foil. Further, instead of folding the tab on top of the main body of the seal, it is known to leave it extending down between the neck of the bottle and the cap. U.S. Pat. Nos. 3,032,325 and 4,209,126 both show a tab which is thus sandwiched between the side wall of the cap and a bottle neck.

It has further been recognized that, where a foil inner seal or the like is provided in combination with a secondary, exterior cap, then to a casual purchaser, there is no clear indication that the inner seal is intact and has not been tampered with. Indeed, a purchaser of a product may not discover that the seal is broken until they come to open and use the product. Thus, U.S. Pat. Nos. 4,576,297 and 4,579,240 show a cap bonded to an inner seal in such a manner that removal of the cap alone ruptures the seal. The cap itself is transparent or translucent, so that a purchaser or first user can check to see that the inner seal is intact. As soon as the cap is removed, the bond between the cap and the inner seal at least is ruptured, thereby providing an indication that the cap at least has been removed or tampered with.

European published applications 109592 and 111900 similarly provide an indication that a cap has been removed or tampered with, so that a purchaser or user can check the integrity of the primary seal, without having to remove the cap. European published application 109,592 further relies upon a colour change to provide such an indication.

However, all these earlier patents rely on a relatively complex combination between the cap and the inner seal. Further, they do not provide any tab or the like for removing the inner seal. Whilst the bond between the cap and the inner seal may be ruptured, to provide the necessary indication of cap removal or displacement, this does not necessarily remove the inner seal. Accordingly, the user is still left with the problem of detaching the inner seal from the neck of the container.

SUMMARY OF THE PRESENT INVENTION

In accordance with the present invention, there is provided a closure for a container; the closure comprising: an inner sealing member, which comprises a membrane having a main portion for securing to the neck of a container and a tab extending out from the main portion; an outer cap, for enclosing the inner seal on the neck of the container, and including a top wall and a depending wall for enclosing the neck of the container, with the tab extending down against an inner surface of the depending wall; and adhesive means bonding the tab to the depending wall, whereby the outer cap cannot be removed without rupturing the adhesive means.

Preferably, the tab extends around the depending wall and includes a second, end portion extending upwardly against the depending side wall, with the adhesive bonding that second, end portion to the cap.

For some configurations of bottle neck and cap, it may be possible to effectively remove the outer cap by a hinging action about the tab, thereby not causing the tab to be detached from the wall of the cap. In such a case, it is preferred to provide two tabs, which advantageously are generally diametrically located, with both tabs secured to the outer wall of the cap. Then the cap cannot be removed without detaching at least one of the tabs.

Preferably, the adhesive means bonds the tab to an exterior layer of the outer surface of the cap wall, which has a first colour. The adhesive means is strong enough to cause a least a portion of this exterior layer to be detached from an underlying interior layer having a second colour, contrasting with the first colour. This then provides a clear colour indication of detachment of the tab, since detachment of the tab detaches a portion of that exterior layer to reveal at least a portion of the underlying interior layer of different colour.

BRIEF DESCRIPTION OF THE DRAWING FIGURES

For better understanding of the present invention, and to show more clearly how it may be carried into effect, reference will now be made, by way of example, to the accompanying drawings, in which.

DESCRIPTIONS OF THE PREFERRED EMBODIMENTS

Figures 1, 2, 3, 4, 5:
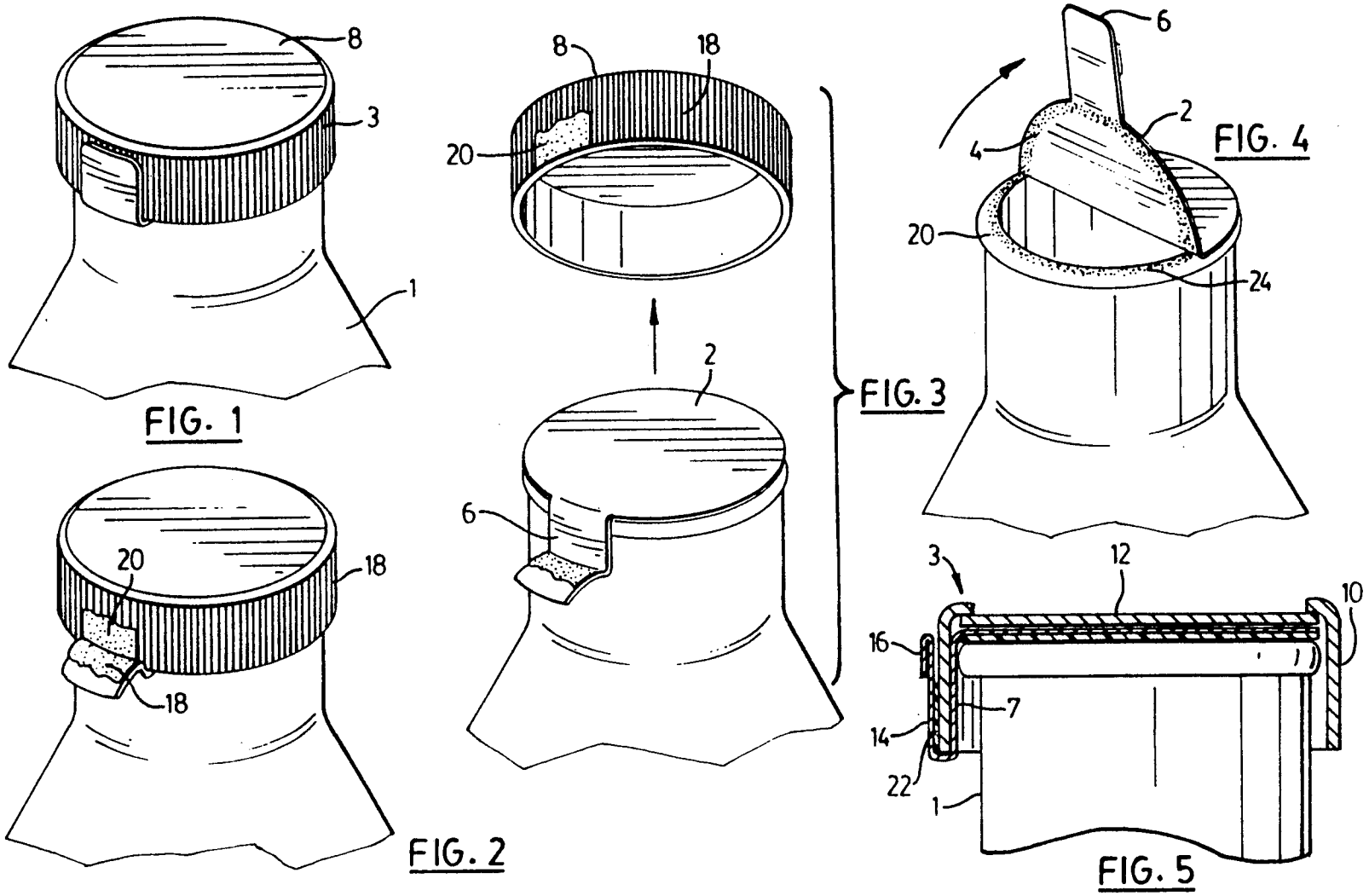
FIG. 1 is a perspective view of a cap in accordance with the present invention mounted on a neck of a bottle.
FIG. 2 is a perspective view, similar to FIG. 1, showing detachment of the tab from the cap.
FIG. 3 is a perspective, exploded view, showing removal of the cap from the inner seal and neck of the container.
FIG. 4 is a perspective view, similar to FIG. 3, showing detachment of the inner seal from the bottle neck.
FIG. 5 is a vertical sectional view through the cap, inner seal and neck combination shown in FIG. 1.

Referring to FIGS. 1 and 5, which show the cap and inner seal completely intact, the neck of the bottle is generally indicated by the reference 1. Bonded to this neck 1 is a metal foil inner seal 2.

In known manner, the foil inner seal 2 has a layer of hot melt adhesive, or any other sort of adhesive 4, on its underside. This layer of adhesive 4 bonds the foil 2 to the neck 1.

Extending out to one side, the inner seal 2 includes a tab 6.

The cap 8 is formed from a thick paperboard in two pieces. Thus it is formed from a circular portion 10 that forms a depending wall enclosing the neck 1, and a top circular part 12 forming a top wall. The cap 8 is a snug or tight fit on the neck 1.

The tab 6 has a first portion 7 extending down between neck 1 and cap 8. The tab 6 then extends down below the bottom of the depending wall 10 and is then folded back upwards to form a upwardly extending exposed tab portion 14.

The foil inner seal 2 with the tab 6 is cut from a foil sheet pre-coated with the adhesive 4 so that this adhesive layer also extends along the underside of the tab 6, but it is not activated to cause it to bond to any other element.

The uppermost part 16 of the upwardly extending tab portion 14 may be folded back as indicated, to form a gripping portion. Alternatively, this folded back portion may be omitted. This folded uppermost part 16 could be bonded together simply by the adhesive 4 on its facing inner surfaces.

The depending wall 10 at least of the cap 8 has an exterior paper layer 18, that is bonded to an interior layer 20, as shown in FIG. 2. The exterior paper layer 18 is provided with a first colour, which is contrasting to the second colour of the interior layer 20, to provide a clear indication of rupture or detachment of the tab 6 from the cap 8, as detailed below. For a plastic cap, the main body could form the inner layer, with the outer layer being a separate layer or finish applied to the cap.

It is not essential to provide the two layers with different colours. Instead, they could be the same colour, with detachment of part of the exterior layer being shown by the tear line or fibre texture.

Adhesive portion 22 is provided bonding a lowermost part 17 of the tab portion 14 to the exterior paper layer 18, as shown in FIG. 5. This adhesive 22 is an approximately rectangular patch of adhesive and has a bond strength greater than that between the interior and exterior layers 18 and 22. Further, since the tab 6 is a metal foil, the adhesive portion 22 will preferentially cause the layers 18, 22 to detach, when the tab 6 is pulled away from the depending wall 10.

In use, the cap 8 is provided with the inner seal 2 already located in position against its top wall 12. The tab 6 is provided folded around the depending wall 10 and bonded by the adhesive at 22 to form a complete closure 3.

A bottler or other installer of the closures 3 fills individual bottles or containers, fits the cap assembly or closure 3 to the neck 1 of the bottle or other container, and then causes the adhesive 4 to bond the foil inner seal to the neck 1.

Where, as is preferred, a hot melt adhesive 4 and a metal foil inner seal 2 are provided, then this is achieved by induction heating, in known manner. The cap assembly 3 is then installed as shown in FIG. 5.

In this configuration, the cap 8 cannot be detached, without rupturing the connection between the cap 8 and the tab 6. Accordingly, it should not be possible for any unscrupulous person to in any way tamper with the cap assembly 3 or the contents of the bottle or other container.

Another advantage of the attachment between the seal 2 and the cap 8 is that unscrupulous or dishonest purchasers cannot switch caps 8 between different containers. Thus, in the dairy industry it is anticipated that certain such purchasers may switch caps between high and low prices products, with the intention of purchasing the higher valued product, for the price of the lower one.

To open the container, a user first grips the doubled over uppermost gripping part 16 of the tab 6 and pulls it downwards, shown in FIG. 2. The adhesive portion 22, as mentioned, then detaches a portion of the exterior layer 18, thereby revealing a portion of the interior layer 20, giving a clear indication that the seal has been broken. This is indicated in FIG. 2.

The cap 8 can then be removed, as shown in FIG. 3. The whole tab 6 can then be grasped and lifted to remove the complete inner seal, as indicated in FIG. 4.

FIG. 4 also indicates, at 24, that part of the adhesive layer 4 may remain on the lip 26 of the neck 1, the lip 26 being the actual surface to which the adhesive bonds. Whether or not such an adhesive layer 24 remains will depend upon the characteristics of the adhesive layer 4 and its relative bond strengths to the inner seal 2 and the lip 26.

After opening of the bottle or container, the foil inner seal 2 can be discarded, and the cap 8 can be refitted, to effect reclosure of the bottle or container for a short period. For example, in the case of dairy products, the bottle can be reclosed until the contents have been entirely used.

Figure 6:
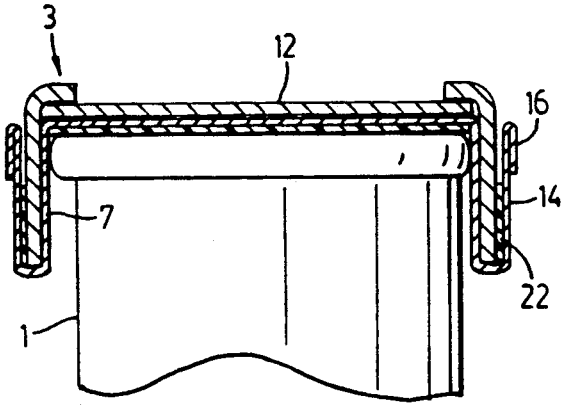
FIG. 6 is a sectional view, similar to FIG. 5 showing a cap and inner seal combination with two tabs.

For some configurations of cap 8 and neck 1, it may be possible to detach the cap by hinging action, without actually detaching the tab 6 from the cap 8. To guard against this, as shown in FIG. 6, two tabs 6, 9 can be provided. The tab 9 is essentially a mirror image of the tab 6, provided diametrically opposite to the tab 6. Then, in order to remove the cap 8, it will be necessary to detach at least one of the tabs 6,9 thereby giving a clear, external visual indication that the cap has been detached and possible the container tampered with.

With regard to preferred materials, the depending wall or circular portion 10 of the cap 8 is formed by helically winding two or more papers of various thicknesses. The other two plys would be approximately 15 point board, with the outer layer forming the interior layer 20. It would then be covered by an outer ply of thinner material, forming the exterior paper layer 18.

The top wall 12 is formed from 20 point paper board.

The inner seal 2 is formed from an aluminum foil having a thickness of 50 microns (2 thousandths of an inch). Adhesive layer 4 is preferably a hot melt adhesive, specially adapted for bonding to a glass surface, such as a surlyn-based adhesive.

As an alternative, instead of the two-part cap 8, a unitary plastic, moulded cap could be provided.

It is possible for the tab to only extend down between the bottle neck and the depending side wall of the cap to be sufficiently transparent or translucent for the tab to be visible through it. The tab would then be bonded to an inner surface of the depending side wall of the cap. This configuration would be visible through the cap side wall, so again there would be externally visible evidence of any tampering with the closure, i.e. separation of the tab from the cap side wall would be visible through the cap side wall.

Reference will now be made FIGS. 7, 8 and 9 and which show alternative embodiments of the present invention. In these, drawings, like parts are given the same reference numerals as in the earlier embodiments.

Figure 7:
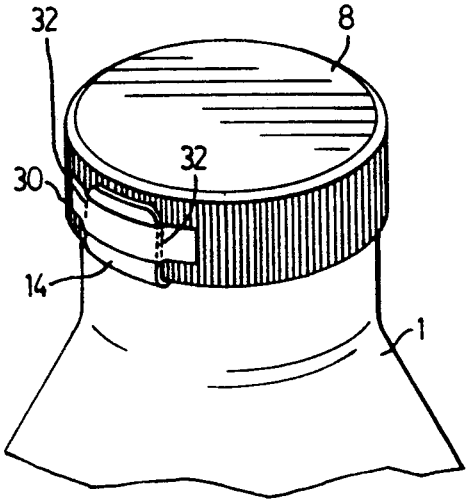
FIG. 7, 8 and 9 are perspective views similar to FIG. 1 of alternative embodiments of the invention.

Referring to FIG. 7, to provide an enhanced degree of security, the upwardly extending tab portion 14 is additionally secured by a security strip 30. This strip 30 is generally rectangular and includes lines 32 providing lines of weakness between ends of the security strip 30 and a central portion thereof. The lines 32 could be perforations or lines cut partially through the strip 30.

The ends of the security strip 30 are bonded by patches of adhesive (not shown) to the cap 8.

In use, when the user grasps the upwardly extending tab portion 14 and pulls it away from cap 8, this ruptures the lines 32. Preferably, the security strip 30 has a surface colour which is different from the colour of the main body of the strip 30, to provide a clear visual indication of any such rupturing.

The central part of the strip 30 could either be secured to the tab portion 14 by a patch of adhesive, or it could be free.

Figure 8:
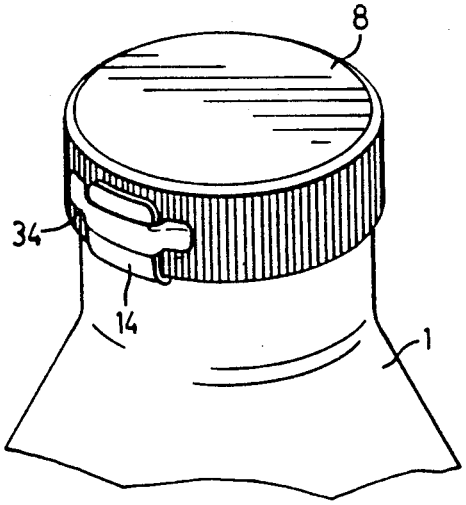

FIG. 8 shows an alternative embodiment having a security strip generally designated by the reference 34. Here, the security strip 34 does not have any lines 32, and is bonded by adhesive both to the upwardly extending tab portion 14, and at either end to the wall of the cap 8. Again, the adhesive portions are not shown as such. When the tab portion 14 is pulled away from cap 8, the security portion 34 is detached with it. Consequently, the ends of the security portion 34 separate from the cap 8. Again, it is preferred that for the adhesive at the ends of the security strip 34 to remove surface portions of the cap wall having a different colour from the underlining material of the cap. This again provides a clear visual indication of any tampering with the container.

Figure 9:
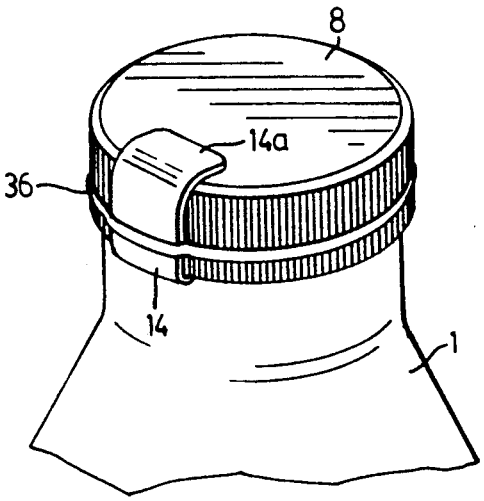

FIG. 9 shows yet another embodiment of security strip, here denoted by reference 36. This security strip 36 is a continuous strip or ring around the periphery of the cap 8. It need not be attached to all points but it is attached at a sufficient number of points, by adhesive patches, that it cannot be removed to enable the upwardly extending tab portion 14 to be detached. Thus, strip 36 could be attached at, for example, four equally spaced portions around the periphery of the cap 8, with or without being attached to the upwardly extending tab portion 14.

Again, FIG. 9 also shows an extended tab portion 14, indicated at 14*a*. It is preferable for the tab to present a portion above any security strip that is suitable sized for gripping between the thumb and forefinger.

When the extended tab portion 14*a* is gripped and pulled downwards, it will rupture the security strip 36, again providing an indication of any tampering. The strip 36 should be a contrasting colour to the wall of the cap 8, to provide a clear visual indication of any such tampering.

In the embodiments of FIG. 8 and 9, as for the FIG. 7 embodiment, the adhesive portion 22 could be omitted or included as desired. It is preferred for security strip to be secured by adhesive to the upwardly extending tab portion 14, to prevent the portion 14 from being slid from underneath the security strip. This might enable some one to tamper with the container or contents, reclose it and slide the tab portion 14 back under the security strip.

A variety of materials could be used for the security strip 30, 34 and 36. They could be formed from paper or like materials of alternatively formed from a plastic film. In the later case, the film could be a least partially transparent.

I claim:

1. A closure for a container, the closure comprising: an inner sealing member, which comprises a membrane having a main portion for securing to the neck of a container and a tab extending out from the main portion; an outer cap, for enclosing the inner sealing member and the neck of a container, and including a top wall and a depending wall for enclosing the neck of the container, with the tab extending down against the inner surface of the depending wall; and an adhesive means bonding the tab to the depending wall whereby the outer cap cannot be removed without rupturing the bond between the tab and the depending wall.

2. A closure as claimed in claim 1, wherein the tab comprises a first portion extending down against an inner surface of a depending wall, and a second, end portion extending upwardly and abutting an outer surface of the depending wall.

3. A closure as claimed in claim 2, wherein the adhesive means comprises a patch of adhesive bonding the upwardly extending tab portion to the outer surface of the cap wall.

4. A closure as claimed in claim 3, wherein the depending wall of the cap comprises interior and exterior layers, with the adhesive patch being bonded to the exterior layer and having a bond strength relative thereto, greater than the bond strength between the interior and exterior layers, whereby, upon separation of the upwardly extending tab portion from the cap depending wall, a portion of the exterior layer is detached, to reveal a corresponding portion of the interior layer.

5. A closure as claimed in claim 4, wherein the interior and exterior layers have contrasting colours, whereby removal of the portion of the exterior layer provides a visual indication of separation from the tab.

6. A closure as claimed in claim 5, wherein the adhesive patch is provided adjacent a lower, free edge of the depending cap wall.

7. A closure as claimed in claim 5, wherein the adhesive patch is provided adjacent a lower, free edge of the cap depending wall, and wherein an uppermost, free end part of the upwardly extending tab portion is folded back on itself and bonded together to form a gripping portion.

8. A closure as claimed in claim 3, which includes a second tab, of generally similar construction to the first-mentioned tab, with the two tabs being provided on opposite sides of the closure, to provide additional security against unauthorized removal to the cap.

9. A closure as claimed in claim 2, wherein the tab is provided with a security strip, and wherein the adhesive means bonds the security strip to the cap wall.

10. A closure as claimed in claim 9, wherein the security strip extends across the second, end portion of the tab, and includes end parts bonded by the adhesive means to the cap wall.

11. A closure as claimed in claim 10, wherein the security strip includes lines of weakness between the end parts thereof and a central part thereof abutting the second end portion of the tab, to permit the central part to be ruptured from the end parts.

12. A closure as claimed in claim 10, wherein the security strip is bonded to the second, end portion of the tab by the adhesive means.

13. A closure as claimed in claim 10, 11 or 12, wherein the adhesive means includes a patch of adhesive bonding a second end portion of the tab to the outer surface of the cap wall.

14. A closure as claimed in claim 9, wherein the security strip comprises a continuous strip extending around the cap, and wherein the adhesive means comprises a plurality of adhesive patches bonding the security strip to the cap wall.

* * * * *